United States Patent [19]

Hellwig

[11] Patent Number: 4,630,961

[45] Date of Patent: Dec. 23, 1986

[54] TRAFFIC INTERSECTION

[76] Inventor: Horst Hellwig, Im Saales 18, D-6338 Huettenberg-Rechtenbach, Fed. Rep. of Germany

[21] Appl. No.: 584,888

[22] Filed: Feb. 29, 1984

[30] Foreign Application Priority Data

Jun. 30, 1982 [DE] Fed. Rep. of Germany ..... 3224429
Jun. 16, 1983 [WO] PCT Int'l Appl... PCT/DE83/00111

[51] Int. Cl.[4] ..... E01C 1/04
[52] U.S. Cl. ..... 404/1
[58] Field of Search ..... 404/1; 14/1; 104/123, 104/124

[56] References Cited

U.S. PATENT DOCUMENTS

| | | | |
|---|---|---|---|
| 1,515,251 | 11/1924 | Graves | 404/1 X |
| 1,689,161 | 10/1928 | Skultin | 404/1 |
| 1,981,361 | 11/1934 | Jones | 404/1 |
| 2,946,267 | 7/1960 | Cedeno | 404/1 |
| 2,949,067 | 8/1960 | Cedeno | 404/1 |
| 3,107,590 | 10/1963 | Cedeno | 404/1 |
| 3,394,638 | 7/1968 | Burrell | 404/1 |

FOREIGN PATENT DOCUMENTS

| | | | |
|---|---|---|---|
| 2106313 | 8/1972 | Fed. Rep. of Germany . | |
| 1523478 | 5/1968 | France | 404/1 |
| 481269 | 12/1969 | Switzerland . | |

OTHER PUBLICATIONS

*A Policy on Geometric Design of Rural Highways,* American Association of State Highway Officials, 1954, pp. 561, 580, 602.

Weg-en Waterbouw, vol. 24, No. 6, Jun. 1964–vol. 25, No. 1, Jan., 1965, H. L. Hoekema: "Kruispunten in Autosnelwegen", pp. 90–94; 118–122; 140–146; 162–167; 196–200; 222–226; 244–251.

VDI Zeitschrift, vol. 103, No. 16, Jun. 1, 1961, Dusseldorf, J. W. Korte, "Stadtverkehrstechnik", pp. 721–729.

International Search Report, PCT/DE83/00111.

*Primary Examiner*—James A. Leppink
*Assistant Examiner*—Matthew Smith
*Attorney, Agent, or Firm*—Schwartz, Jeffery, Schwaab, Mack, Blumenthal & Evans

[57] ABSTRACT

In a road intersection unrestrained by traffic signal controllers the intersection is classified into a central zone and into interchange zones providing for better safety on the road and for continuous flow of traffic. All entrances and exits are placed in the interchange zones. Further, the interchange zones include overpasses for interchanging the position of lanes before they enter the central zone.

11 Claims, 18 Drawing Figures

B1'
B1
B1''
C
Ro
A1

B2'''
B2'
B2
B2''
B2''''
A2

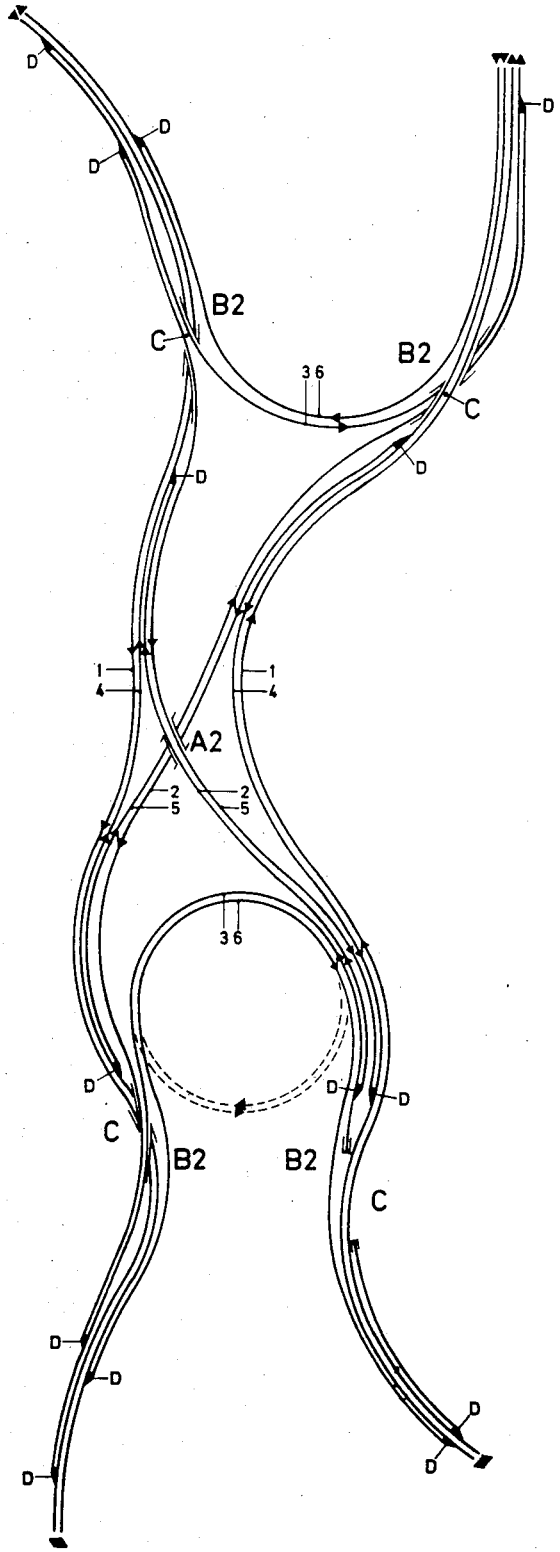
FIG. 3
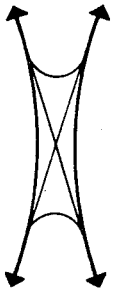

B2
C
D
A2
Ro
1
2
3
4
5
6

TRAFFIC INTERSECTION

This application is filed under the provisions of 35 U.S.C. §120 and is based on international application No. PCT/DE83/00111, which was filed June 16, 1983 and which designated the United States.

BACKGROUND OF THE INVENTION

1. Field of the Invention

This invention relates to intersections for crossing streets, roads or highways having three or four branch lanes and providing for flow traffic regardless of the number of streets and the traffic direction. More particularly this invention relates to intersections comprising a two-level interchange of the inside lanes with the possibility of selecting a lane according to a geographic destination before approaching the intersection.

2. Description of the Prior Art

In projecting and constructing intersections having three or four branch lanes two structures are known, the so-called trumpet and the clover leaf, both comprising two-level interchanges. The use of these known structures is not satisfactory for several reasons. Due to minimum radius turns, fast flow-traffic is not possible using a trumpet. Traffic making a turn must pass through a 270 degree curve having only a minimum radius. The number of entrance and exit lanes, hereinafter called points of conflict, require special attention.

Such known intersections require large areas. A clover leaf having four branch lanes must include a 270 degree curve with a small radius. The number of points of conflict in rapid succession is as large as the area occupied.

SUMMARY OF THE INVENTION

It is an object of the present invention to provide a structure for crossing streets, roads or highways in an intersection without traffic signal controllers having three of four branch lanes while providing for variable traffic problems requiring only two levels and a minimum area.

For such an object, according to the present invention the intersections are classified functionally into central zones and interchange zones, the latter corresponding with the number of branch lanes. In this way a three or four-branched central zone is passed by a main traffic stream without any points of conflict. Necessary additions or reduction of lanes take place alongside the branches. A driver can make a decision about his desired direction before approaching the intersection by taking the announced lane. In the interchange zones, the lanes are arranged as they come from the central zone forming two uniform two-lane roads in a known manner by symmetrically or interchanging the innermost lanes in an overpass. According to the present invention however priority roads may be provided in any direction by asymmetrically interchanging groups of lanes. In this connection the number of lanes is of no consequence. Arranging the points of conflict between the central zones and an overpass in the interchange zones results in a low cost design having less lanes crossing in the overpass.

BRIEF DESCRIPTION OF THE DRAWINGS

Several preferred embodiments of the present invention will hereinafter be described by reference to the accompanying drawings, in which

FIG. 3 is a plan view of a deformed road intersection having four branch lanes, the intersection being adapted to conform to the local topography;

DESCRIPTION OF THE PREFERRED EMBODIMENTS

Figures 1A, 1B, 1C, 2A, 2B, 2C, 2D, 2E:
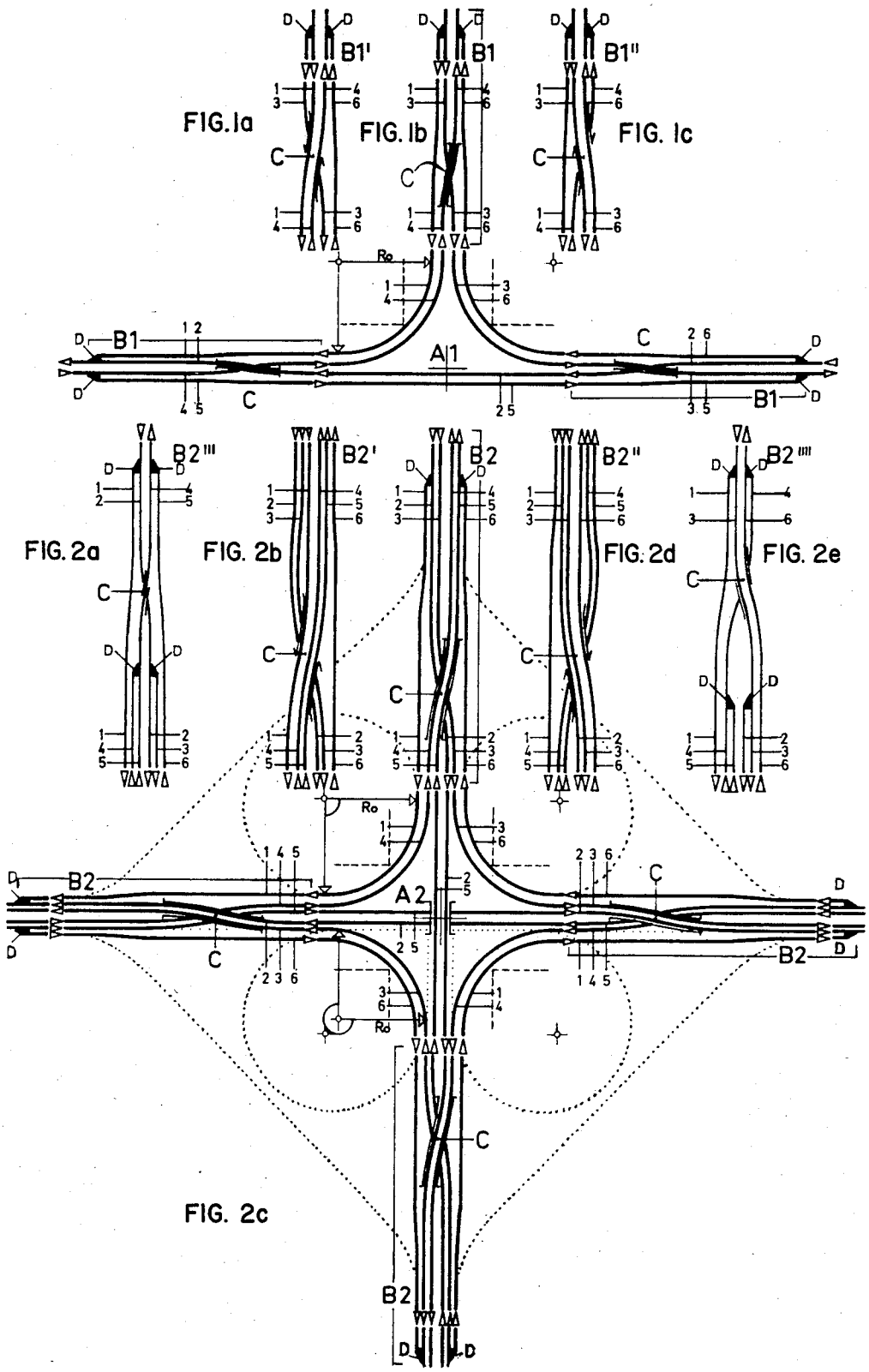
FIGS. 1*a*–1*c* are plan views of road intersections having three branch lanes, constructed according to the present invention.
FIGS. 2*a*–2*e* are plan views of road intersections having four branch lanes.

Referring first to FIG. 1*b*, the fundamental principle of an intersection having three branch lanes is shown as an example of the present invention. From the drawing, it can be seen that the lanes 1 and 4 as well as 3 and 6 form quadrants with the same radius $R_o$, enclosing, in combination with the straight lined lanes 2 and 5, a triangular area which represents the central zone A1. The areas where traffic merges or separates are referred to as points of conflict. All the points of conflict D, in all six, are outside of the central zone A1 and within interchange zones B1. Each interchange zone B1 has an overpass C.

As shown in FIG. 1*a*, for conducting a main stream to the left (as viewed in the Figure), the lane 1 within the interchange zone B1' is interchanged with lane 3 in addition to lane 4 by having lanes 1 and 4 remain at the same level on the overpass C. Lane 1 is then situated in the central zone A1 as the outer lane of the main stream. As can be seen in the drawing, a main traffic stream is one which includes two oppositely directed lanes which are uninterrupted through the intersection and extend essentially parallel to each other.

Similarly, in FIG. 1*c*, lane 6 is interchanged at overpass C in addition to lane 3 in order to direct a main stream to the right (as viewed in the Figure).

The four-branched intersection shown in FIG. 2*c* provides a central zone A2 as well as four interchange zones B2. Four overpasses C are provided in the four interchange zones B2 and one overpass C is provided in the central zone A2. The minimum number of necessary points of conflict amounts to sixteen. These are situated in the interchange zones B2 of the four branches of the intersection at large distances from each other.

FIG. 2*b* shows one branch of a four branch intersection designed for conducting a main traffic stream in a direction turning to the left (as viewed in the Figure). This is accomplished by having lane 1 interchange with lanes 4 and 5 at the same level as overpass C. Also, in this case, the lanes within the central zone A2 would be situated outside of the main traffic stream comprising lanes 1 and 4.

FIG. 2*d* shows a variation in which a main traffic stream is established to the right (as viewed in the Figure). Here, lane 6, as well as lanes 2 and 3, are interchanged at the same level of overpass C to form a main traffic stream comprising lanes 3 and 6. Here again, the lanes within the central zone A2 would be outside of the main traffic stream.

FIG. 2*a* shows a low cost alternative to the interchange zones of FIG. 2*c*. In FIG. 2*b*, more points of conflict are used in order to reduce the number of lanes necessary on the overpass C. This form of the invention can be used where there is sufficient space between the overpass in the interchange zone and the overpass in the central zone. Thus, points of conflict D can be positioned between the central zone and the overpass C in the interchange zone. Accordingly, it can be seen that by the use of extra points of conflict, lanes 3 and 4 do not have to be interchanged at the overpass C.

FIG. 2*e* shows a low cost alternative to the interchange zone of FIG. 2*d*. Here it can be seen that only the main traffic stream comprising lanes 3 and 6 are interchanged with lane 4, thus reducing the size of the overpass. Lanes 2 and 5 are formed by additional points of conflict D. The main traffic stream is again established to the right (as viewed in the Figure), with lane 6 situated as the outermost lane of the central zone.

FIG. 3 shows a four-branched intersection which incorporates the low cost design of FIG. 2*e*. The design of the intersection is elongated and deformed so that all of the two-lane roads 1,4 2,5 and 3,6 may follow natural grades. The central zone A2 as well as the interchange zones B2 may be adjusted in size to suit the landscape in full agreement with the teaching of the present invention.

Figure 4:
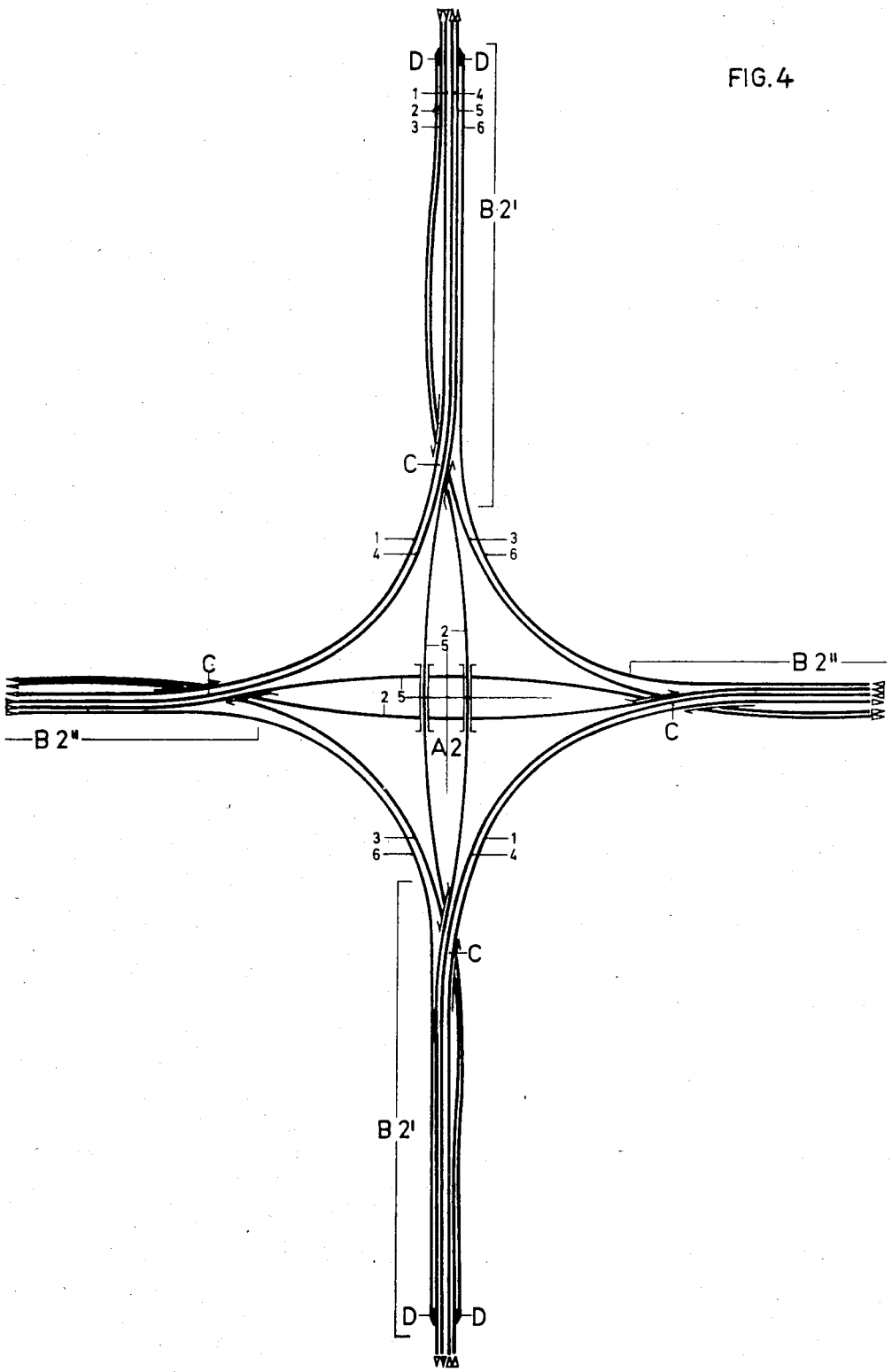
FIG. 4 is a plan view of another road intersection having four branch lanes and two main roads.

FIG. 4 shows a further embodiment of a four-branched intersection having opposing identical interchange zones B2′, in which two main traffic streams 1,4 and 1,4 turn off diagonally and are provided with unrestricted priority. The central zone A2 has one overpass, and within the interchange zones B2′, B2″ there are four overpasses C in all. The interchange zones B2′ and B2″ correspond with those of FIGS. 2*b* and 2*d*, respectively. Further, it is evident that the initiated curves of the turning lanes 1,4 and 3,6 maintain their turning direction.

Figure 5:
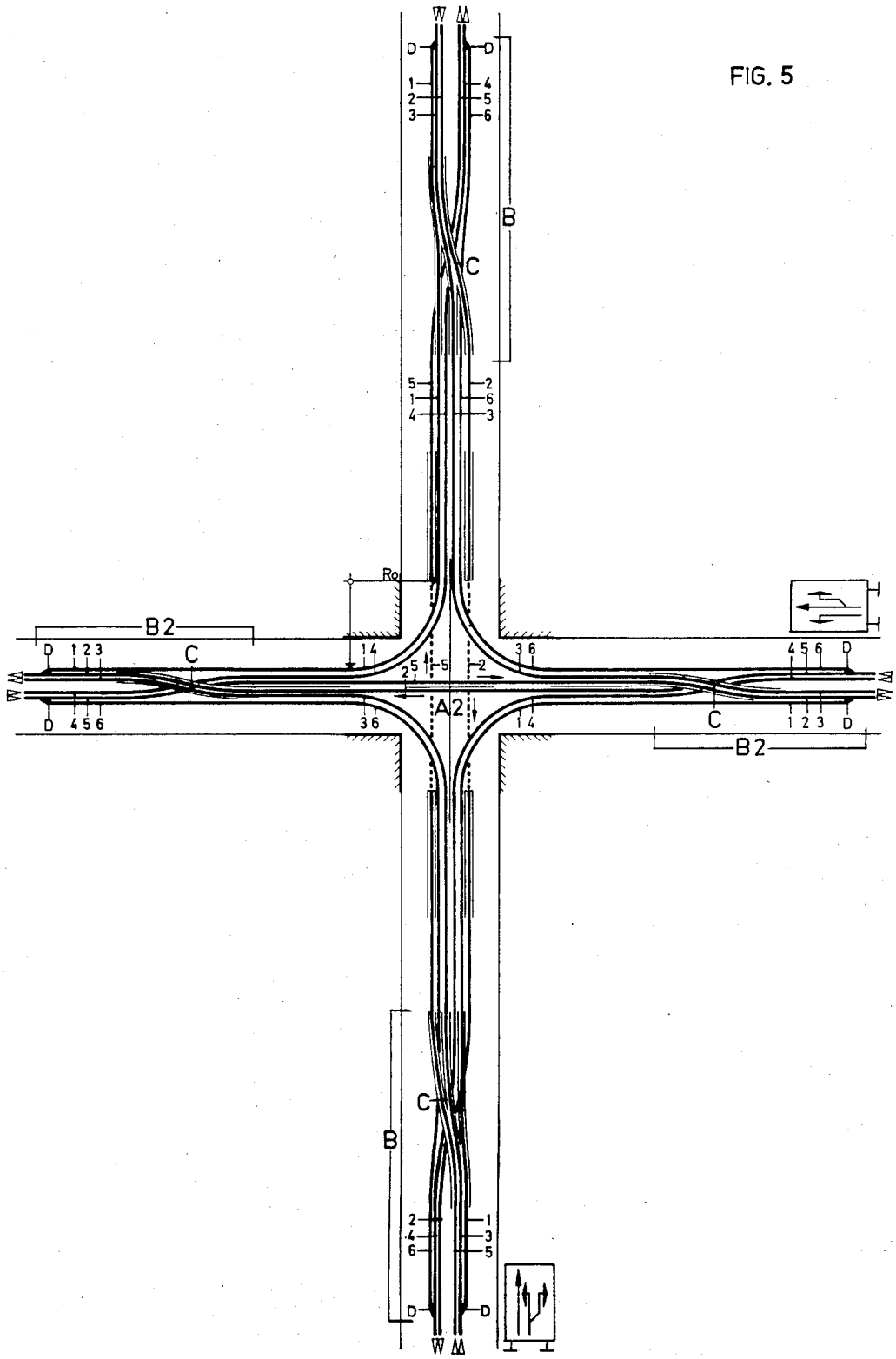
FIG. 5 is a plan view of another road intersection having four branch lanes in a business district, showing a miniaturized central zone in a first level.

The embodiment illustrated in FIG. 5, shows a straight-on traffic stream (lanes 2,5 at the top of the drawing) of a north-south route (extending from top to bottom as viewed in the drawing) being removed into an outside position. As a result the interchange within the two overpasses of the interchange zones again is possible within only two levels, the north-south traffic stream being preferred. This stream is crossed within the central zone A2 by two lanes leading to local districts.

Figure 6:
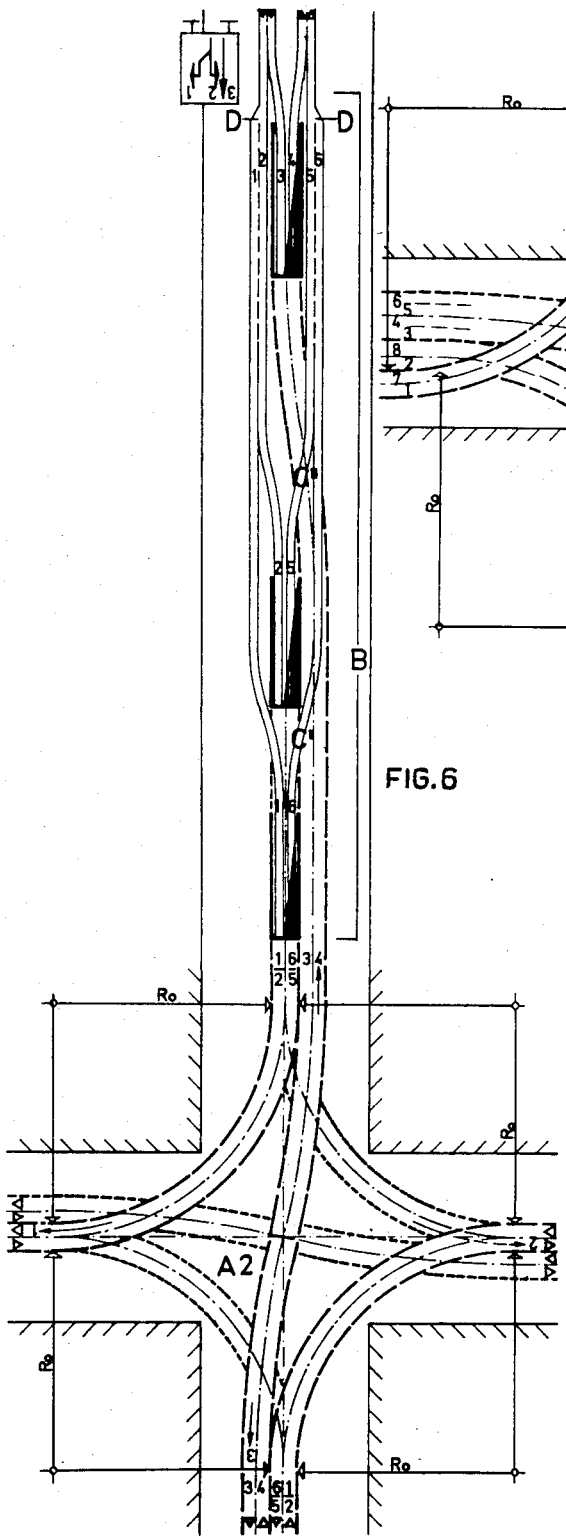
FIG. 6 is a plan view of another road intersection showing a miniaturized central zone in a second level.
Figure 7:
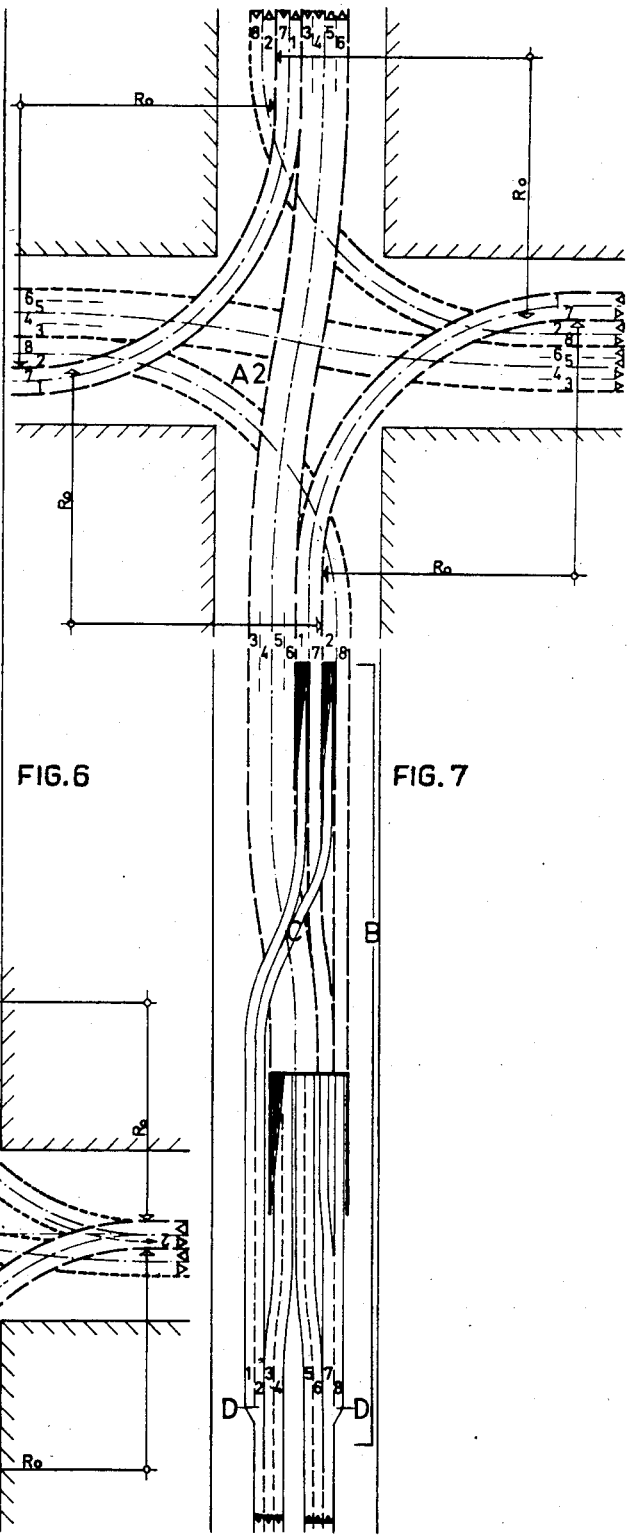
FIG. 7 is a plan view subsequent to the road intersections of FIGS. 6 and 7, showing the miniaturization in a third stage.

The embodiments of FIGS. 6 and 7 are applicable to an underground crossing confined to four corners, and which cannot include a central zone according to FIG. 2. This crossing is formed by placing on each of two low levels two quadrant-elements diagonally opposed to each other. Two straight-on traffic streams extend within the corresponding levels in a symmetrical direction of turning. The embodiments of FIGS. 6 and 7 differ from each other in that the quadrant-elements are disposed two by two vertically on top of one another in FIG. 6, and side by side in FIG. 7. This different positioning influences their possible radii. According to this so-called step-by-step miniaturization, the ordering of the traffic is accomplished by specified lanes organized into three groups (FIG. 6) or into two groups (FIG. 7)) at the road surface. With reference to the upper portion of FIG. 6, the roads comprise incoming lanes 1,2,3 and outgoing lanes 4,5 and 6. Lanes 3 and 4 first come to depth, second the lanes 2 and 5 and finally the lanes 1 and 6.

In the lower portion of FIG. 7, there are outgoing lanes 1,2,3,4 and incoming lanes 5,6,7,8. The first ramp receives the lanes 3,4; 5,6; and 7,8 and the second pair of ramps receives the lanes 1,2. Any necessary reduction of lanes may be accomplished in the continuing branches. The area at street level is for pedestrians and may serve as a multipurpose center having pedestrian passageways.

Figure 8:
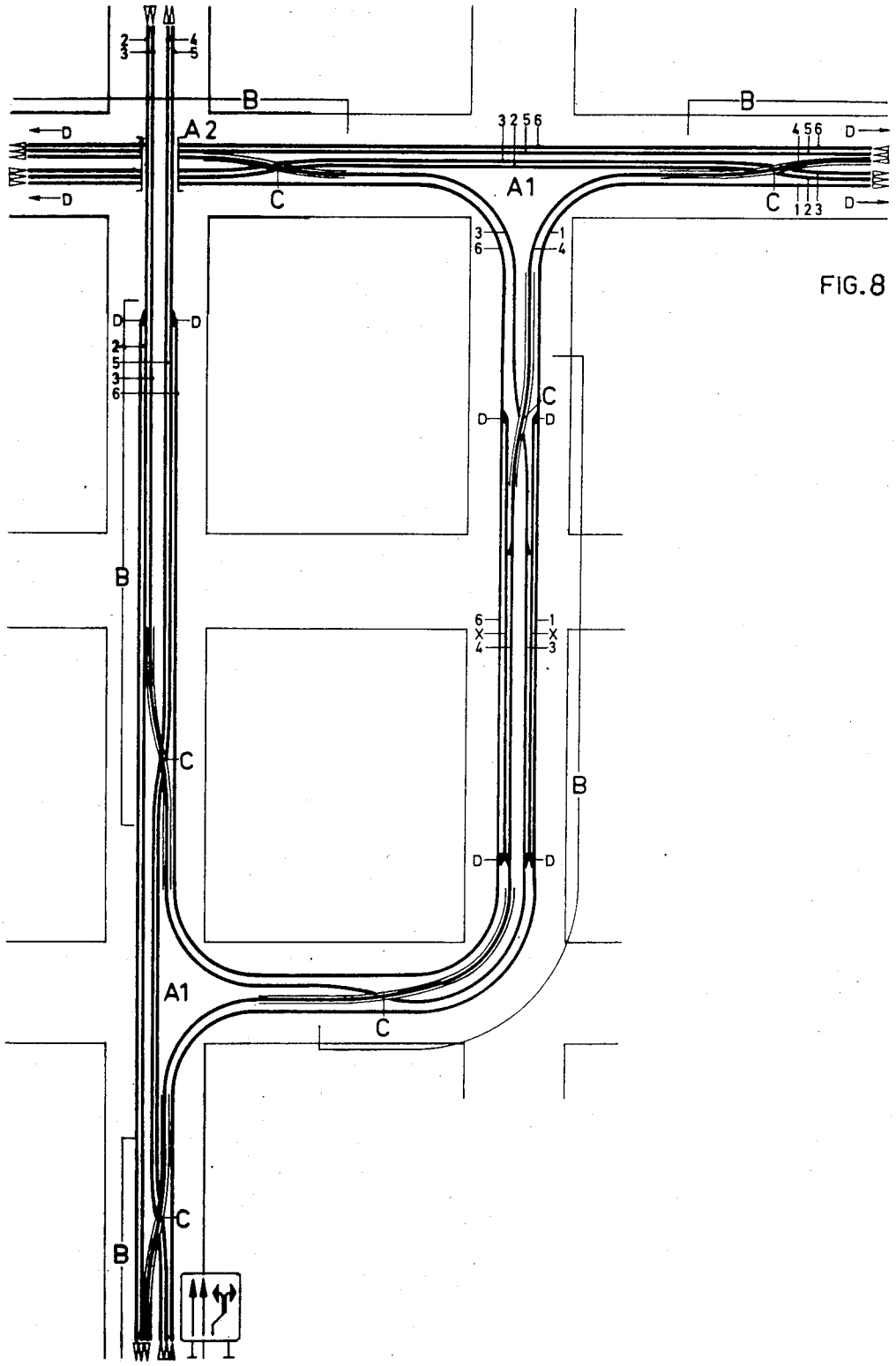
FIG. 8 is a plan view of a road intersection having four branch lanes and being situated in a business district, the intersection being composed of two three-branched intersections according to FIG. 1.

FIG. 8 shows an intersection for use with checkered street blocks, as often occur in towns. This intersection provides a four-branched intersection, which is composed of two three-branched central zones A1. It can be seen that there are no turning lanes with the crossing range at A2.

Figure 9:
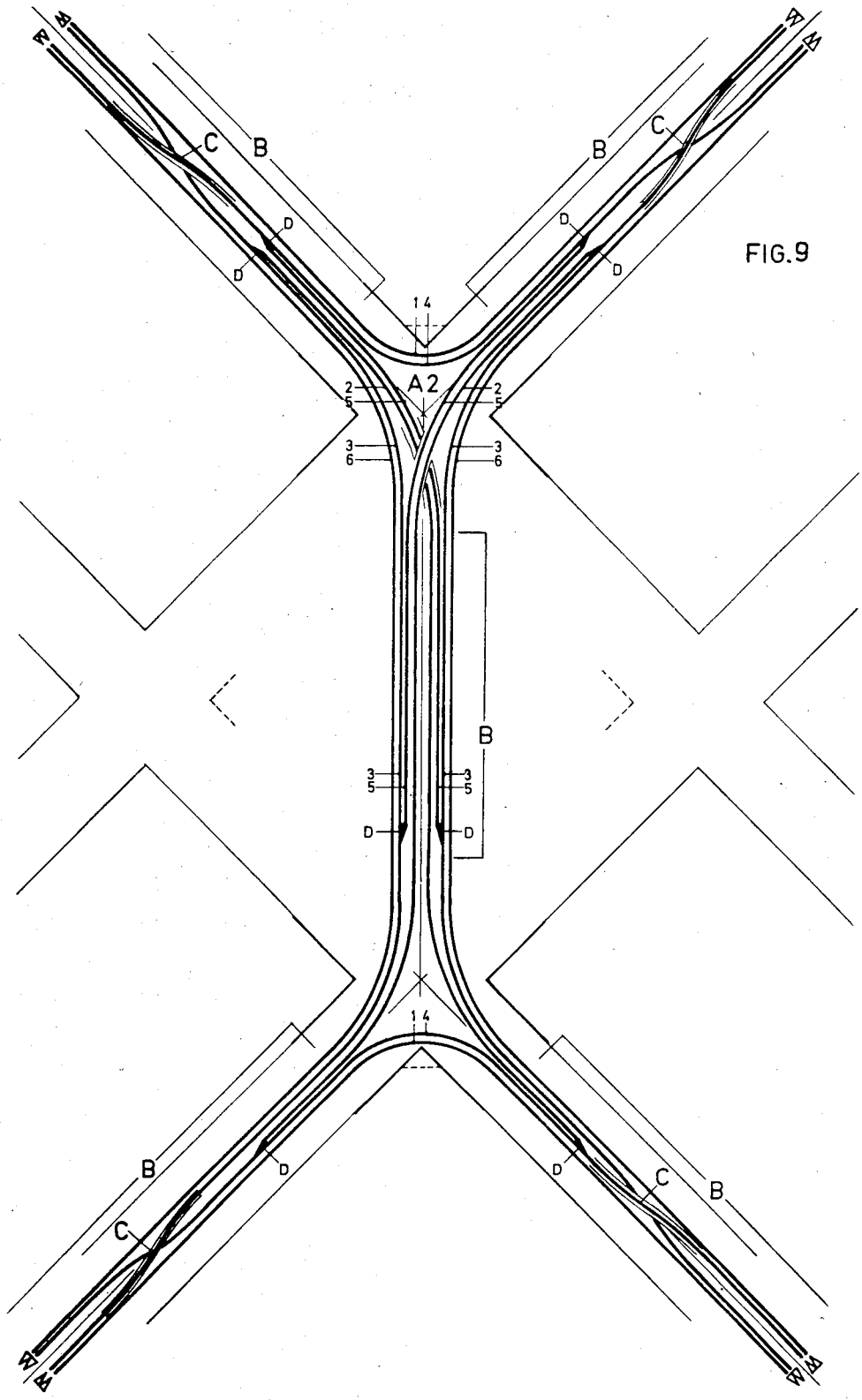
FIG. 9 is a plan view of a further, H-shaped intersection.

FIG. 9 shows an embodiment of the present invention according to FIG. 2*e* having frour branch lanes. The central zone A2 in this case however is deformed ito an H-shape. This intersection provides long, straight-lined connecting roads formed by the lanes 2,5 on the left; 2,5 on the right; 3,6 on the left; and, 3,6 on the right. In this embodiment the low cost design of FIG. 2*e* is applicable to both sets of lanes 3,5. That is, points of conflict are provided between these lanes in the central interchange zone B in order to form reduced width lanes within the triangle opposite the central zone A2. The low cost design is also used within this triangle as well as within the central zone A2 by formin lanes 2,5 on the left and lanes 2,5 on the right using points of conflict D. Further, points of conflict D are used to merge lanes, 2,2 with lane 4 in the lower triangle adjacent overpass C. This results in an interchange of only two lanes each within the four overpasses C.

Figure 10:
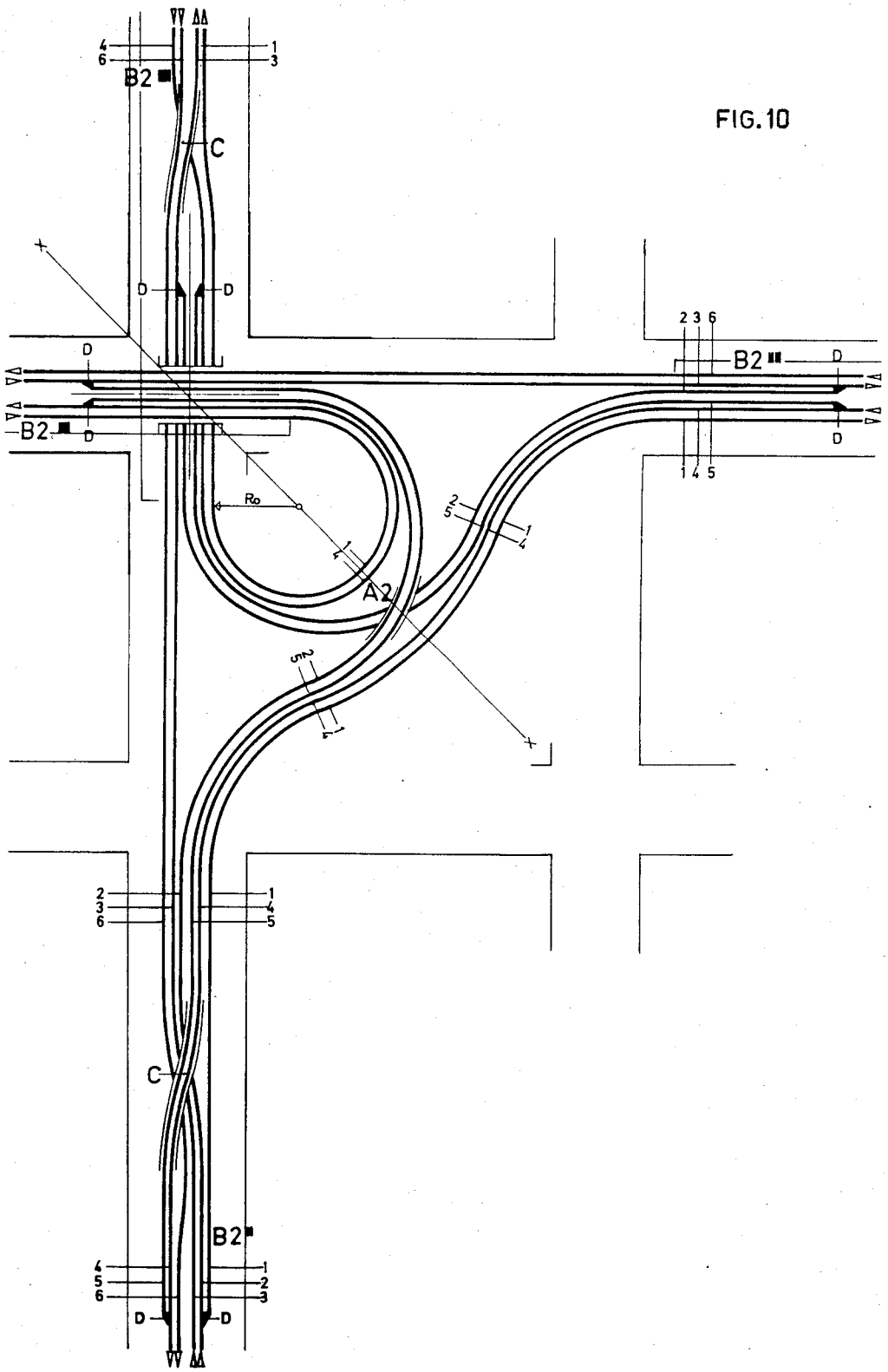
FIG. 10 is a plan view of another road intersection in a business district, all the side-traffic being arranged on one quadrant.

FIG. 10 shows another embodiment of the present invention. The intersection of FIG 10 has three vacant corner locations. All the turning traffic is arranged on one quadrant. This is accomplished here by curving the central zone A2 about a diagonal system axis x—x in such a way that turning lanes 1 and 4 form a curve of about 270 degrees. It can be seen that this embodiment is used if two straight-on traffice streams (north-south and east-west) are preferred. Moreover, the turning lanes 1 and 4, extending from south to east, may be provided with a large radius about the vacant quadrant. These turning lanes further may become a main traffic stream by mirror-imaged interchange within the corresponding overpasses (not shown). Also in this embodiment low cost designs are realized by using points of conflict for getting into and out of lanes of both the side-roads from each to north and west to south. In the same way a low cost design can be used for the traffic stream from each to west (lanes 2 and 5), the traffic streams from the south passing in such a manner that the points of conflict D are beyond the overpass C.

Figure 11:
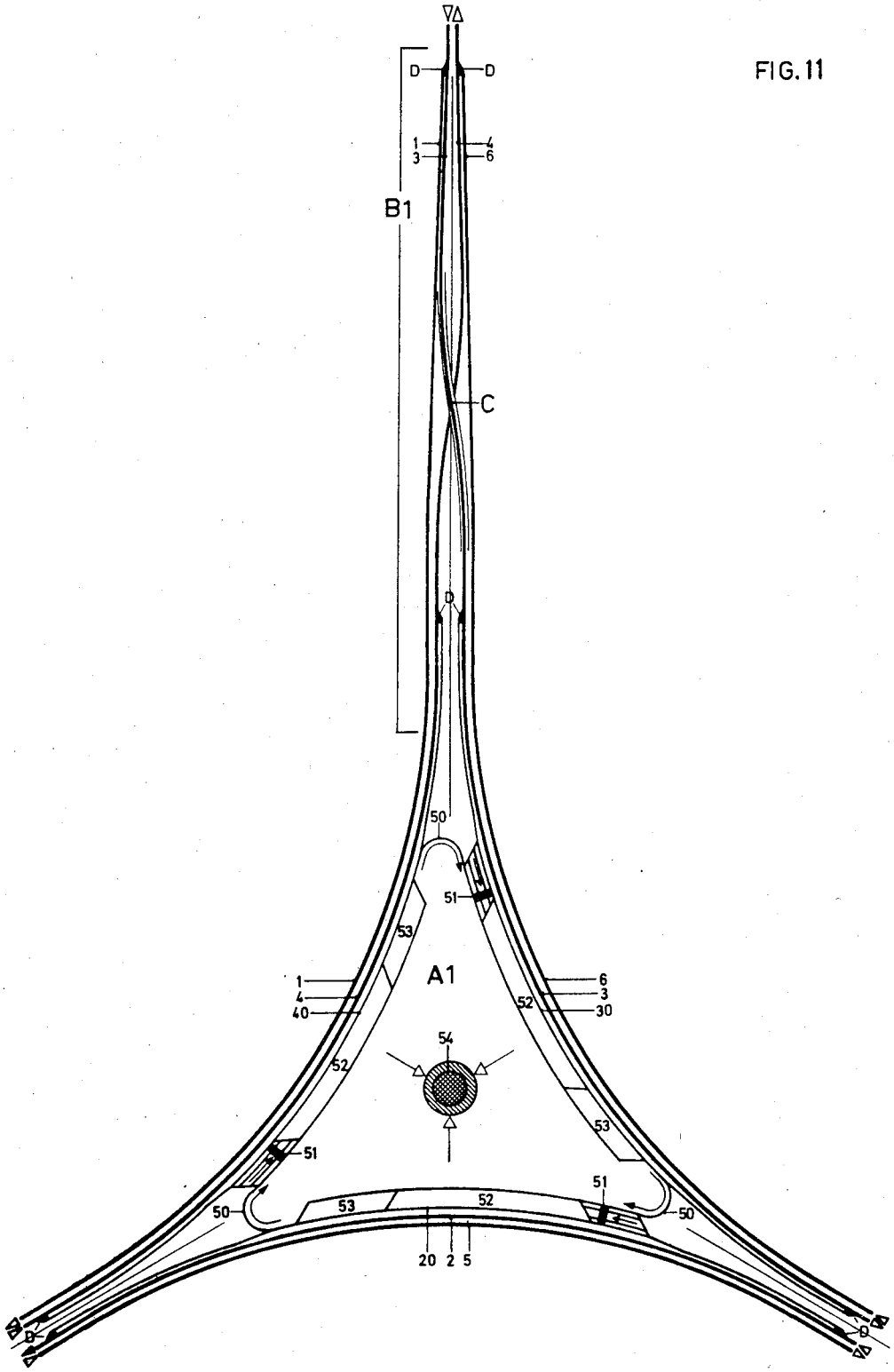
FIG. 11 is a plan view of a road intersection having three branch lanes according to FIG. 1 and forming a road house assembly.

Reference is now had to FIG. 11 to describe a three-branched intersection according to FIG. 1*b*, including a resting facility as an operational unit. In this embodiment each of the three lanes 2,3,4 which curve around the central zone A1 are related to a parallel side lane 20, 30, 40, respectively. Each side lane provides access to a gasoline station 51, a parking place for automobiles 52 and a parking place for trucks 53. Within the inside of central zone A1, a road house 54 is located, including various types of businesses and shops. The side lanes 20, 30, 40 are integrated into a circular road by means of limbs 50. The circular road may be traversed clockwise. It can be seen that in this structure an arrival from and a departure for all directions is possible without problems. In the interchange area B1 the points of conflict again are arranged beyond the overpass C.

Figure 12:
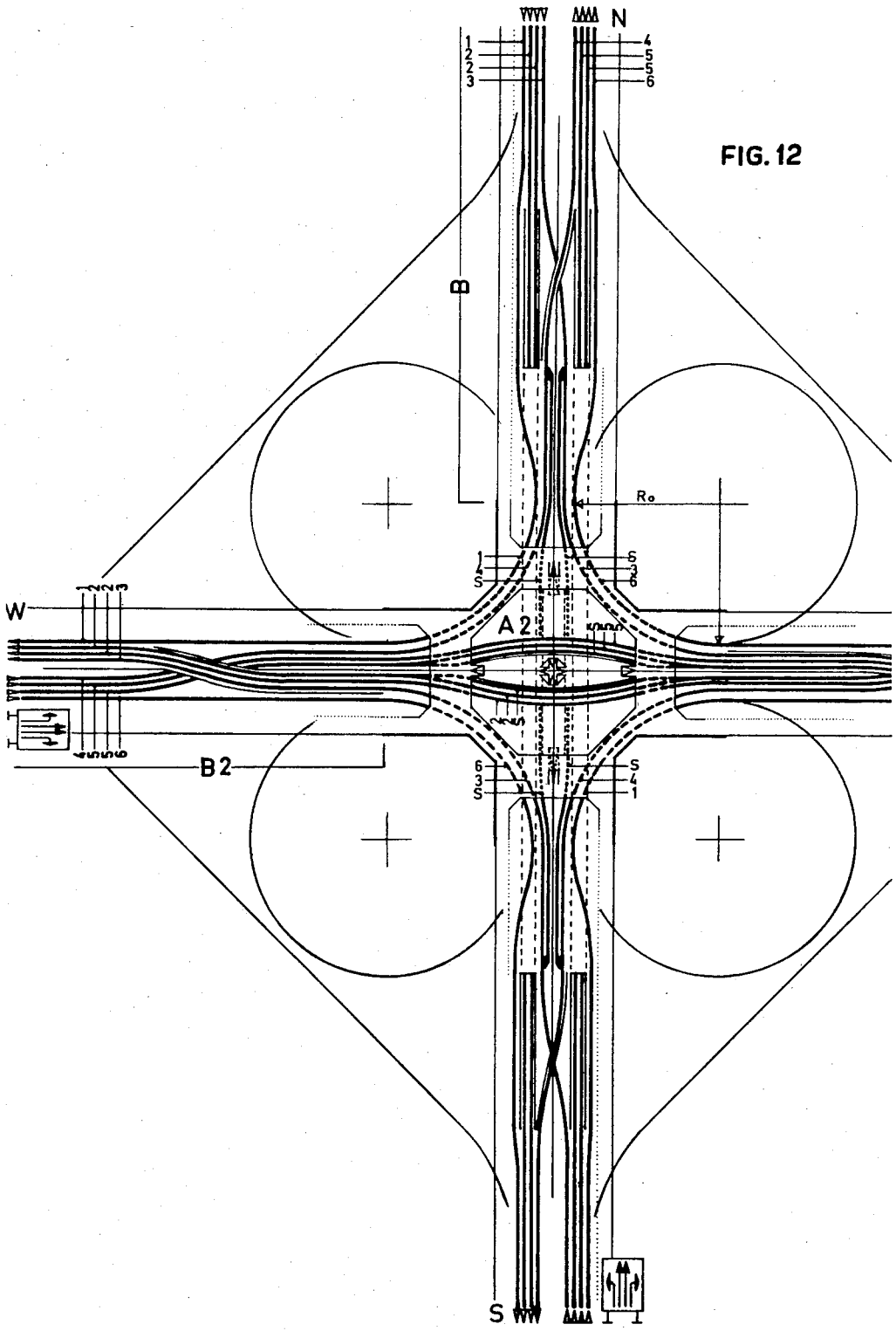
FIG. 12 is a plan view of a road intersection having four branch lanes according to FIGS. 2 and 5, but in an open excavation providing traffic islands for changing the buses.

FIG 12 shows a further development of the structure of FIG. 5. In this embodiment the north-to-south streams within the central zone A2 are located as outside lanes. The approaches from north/south however are systematically designated according to lane position and the two lanes 3,4 only are interchanged within both the interchange zones B. Moreover, within the central zone A2 bus stops S are provided. At these bus stops, riders have the option of changing direction in all directions. This is accomplished by arranging islands within the center of the central zone A2. The pedestrian traffic here takes place on a platform at street level above an open excavation of the central zone A2 having access to the four islands.

What is claimed is:

1. An intersection for handling traffic from a plurality of intersecting roads, each of said roads having oppositely directed lanes for oppositely traveling traffic, said intersection comprising:

a cental zone into which each of said roads extends, said lanes being divided into incoming lanes relative to said zone and outgoing lanes relative to said zone;

an interchange zone associated with each of said roads entering said central zone, each interchange zone being outside of said central zone and including an overpass for exchanging the relative position of at least two of said oppositely directed lanes for each of said roads, said overpass being used to exchange all lanes which require exchanging in said interchange zone; and wherein said lanes are divided into main traffic lanes and access lanes for each of said roads, said access lanes connecting to said main traffic lanes at points of conflict, and said main traffic lanes of certain of said roads being connected to provide a main traffic stream, there being at least as many incoming lanes in each road, prior to said overpasses, as the directional choices available and all points of conflict on said incoming lanes being positioned prior to said overpasses and on the same level, all points of conflict on said outgoing lanes being positioned after said overpasses whereby the choice of direction is selected by entering a unique lane for a particular direction prior to said interchange zone.

2. An intersection according to claim 1, wherein each of said points of conflict is disposed to the right relative to traffice flow.

3. An intersection according to claim 1, wherein said intersection has four branches for connecting four roads, and wherein said four branches are positioned opposite one another relative to said central zone, the innermost oppositely directed lanes of each road being interchanged at said overpasses, the innermost exchanged lanes of each road connecting with the innermost exchanged lanes of the road positioned opposite said each road to form two sets of through lanes, and an overpass disposed in said central zone for permitting said two sets of through lanes to pass each other at different levels.

4. An intersection according to claim 1, wherein at least one of said overpasses includes the two innermost oppositely directed lanes of the associated road being at the same level of siad overpass for establishing a two-directional main traffic stream which turns away from said associated road.

5. An intersection according to claim 1, wherein said intersection has four branches and said central zone is disposed beneath ground level, a two-directional main traffic stream being established between opposite roads relative to said central zone, said access lanes crossing one another on two levels below ground.

6. An intersection according to claim 5, wherein said access lanes are divided into pairs of oppositely directed lanes, said pairs being disposed in pairs of oppositely directed arcs, each pair of arcs being at a different underground level, and wherein said pairs of access lanes emerge at ground level.

7. An intersection according to claim 6, including a pedestrian zone on the surface above said cental zone.

8. An intersection according to claim 6, wherein said access lanes are associated into pairs of oppositely directed lanes, the pairs of lanes associated with each road being disposed laterally adjacent one another and laterally adjacent to main traffic lanes of an associated road, said pairs of lanes crossing each other at two levels beneath ground level.

9. An intersection according to claim 1, wherein said intersection has three branches, and in combination with a second three-branched intersection said two three-branched intersections being combined to form a single four-branched intersection.

10. An intersection according to claim 6, wherein said pairs of access lanes diverge to opposite sides of said associated road at ground level.

11. An intersection according to claim 1, wherein said intersection is shaped to conform to existing terrain.

* * * * *